United States Patent [19]

Wright et al.

[11] Patent Number: 4,576,329

[45] Date of Patent: Mar. 18, 1986

[54] COLLAPSIBLE CONTAINER

[76] Inventors: Paul C. Wright, Brookland House, 46 Kneesworth St., Royston, Hertfordshire; Robert Gault, 12 Ranmoor Cliffe Rd., Sheffield, both of England

[21] Appl. No.: 604,011

[22] Filed: Apr. 26, 1984

[51] Int. Cl.[4] ..... B65D 5/36

[52] U.S. Cl. ..... 229/41 R; 190/107; 190/115

[58] Field of Search ..... 229/41 R, 41 B; 190/107, 115

[56] References Cited

U.S. PATENT DOCUMENTS

| | | | |
|---|---|---|---|
| 840,814 | 1/1907 | Wolf | 229/41 R |
| 977,770 | 12/1910 | Wolf | 229/41 R |
| 2,151,472 | 3/1939 | Hubbard | 229/52 B |
| 2,554,215 | 3/1951 | Schell | 190/115 |
| 2,950,484 | 8/1960 | Jaffe | 229/41 B |
| 3,376,994 | 4/1968 | Flinn | 229/41 R |
| 4,014,292 | 3/1977 | Coughlin | 229/41 R |

FOREIGN PATENT DOCUMENTS

| | | | |
|---|---|---|---|
| 593373 | 3/1945 | United Kingdom . | |
| 650858 | 3/1951 | United Kingdom . | |
| 1541210 | 2/1979 | United Kingdom . | |
| 2063221 | 6/1981 | United Kingdom | 229/41 B |
| 2106868A | 4/1983 | United Kingdom . | |
| 2129777A | 5/1984 | United Kingdom . | |

*Primary Examiner*—George E. Lowrance

*Attorney, Agent, or Firm*—Birch, Stewart, Kolasch & Birch

[57] ABSTRACT

A collapsible container of for example a thermoplastic material comprises a bottom 10, side walls 11 and end walls 13. The side walls and bottom are made up of regions interconnected by fold lines 15 and 16, enabling the container to be folded flat and then folded on itself to provide a compact article. The side walls may be attached to the end walls by flaps 17 provided with press studs 18. Handles 22 and 23 for carrying the erect container may be provided in the side and end walls, and a handle 20 for carrying the collapsed container may be attached to the bottom by portions 21 of the handle engaged in slots in the bottom.

6 Claims, 4 Drawing Figures

COLLAPSIBLE CONTAINER

BACKGROUND OF THE INVENTION FIELD OF THE INVENTION

The present invention relates to collapsible containers, which are suitable for a variety of purposes when erected and convenient to carry when collapsed.

SUMMARY OF THE INVENTION

A container according to the invention is formed of stiff material and comprises a bottom and a plurality of sides which rise from the periphery of the bottom in the erected condition. It is characterised in that the bottom and at least two opposite sides each comprise a plurality of portions or areas which are flexibly linked to one another and to the remaining sides of the container, such that the container can be collapsed by relative folding of the portions or areas of the at least two sides and inward folding of the remaining sides close against the bottom to form a flat structure and is further characterised in that the portions or areas of the bottom are foldable relative to one another to double the flat structure upon itself and form a compact article convenient for carrying.

The container preferably includes means for fastening portions thereof together to maintain the fully collapsed container in its compact condition. A handle for carrying the fully collapsed container may be provided, preferably attached to the bottom of the container, in a position where it is exposed when the container is in its compact condition. Carrying handles may also be provided in a desired number of the sides of the container, for use when it is erected.

The bottom and sides of containers of this invention may be made of a variety of materials, which may be linked together by means or materials appropriate to the bottom and side material employed. The containers are, however particularly adapted for fabrication by the method described in U.S. Pat. No. 1,603,489, according to which a blank is prepared by providing a sheet of thermoplastics material of predetermined shape, heating the sheet along a predetermined pattern of straight and/or curved lines on one face thereof to a temperature at which the material is softened along the lines, folding the sheet along the lines in an appropriate jig while the material of the sheet is still soft along the lines, and retaining the sheet in its folded state in the jig until the material along the lines is cool and stiffens, the pattern of lines conferring on the blank a tendency to assume the folded condition necessary for erection of the article.

The sides of the blank are then erected, by folding up about the fold-lines defining the periphery of the bottom, and secured together to form the desired container, which is then ready to be collapsed by folding about the remaining folds or hinge lines to bring the container into its compact condition.

BRIEF DESCRIPTION OF THE DRAWINGS

The invention will be further described, by way of example, with reference to the accompanying drawings in which.

DETAILED DESCRIPTION OF THE PREFERRED EMBODIMENT

Figure 1:
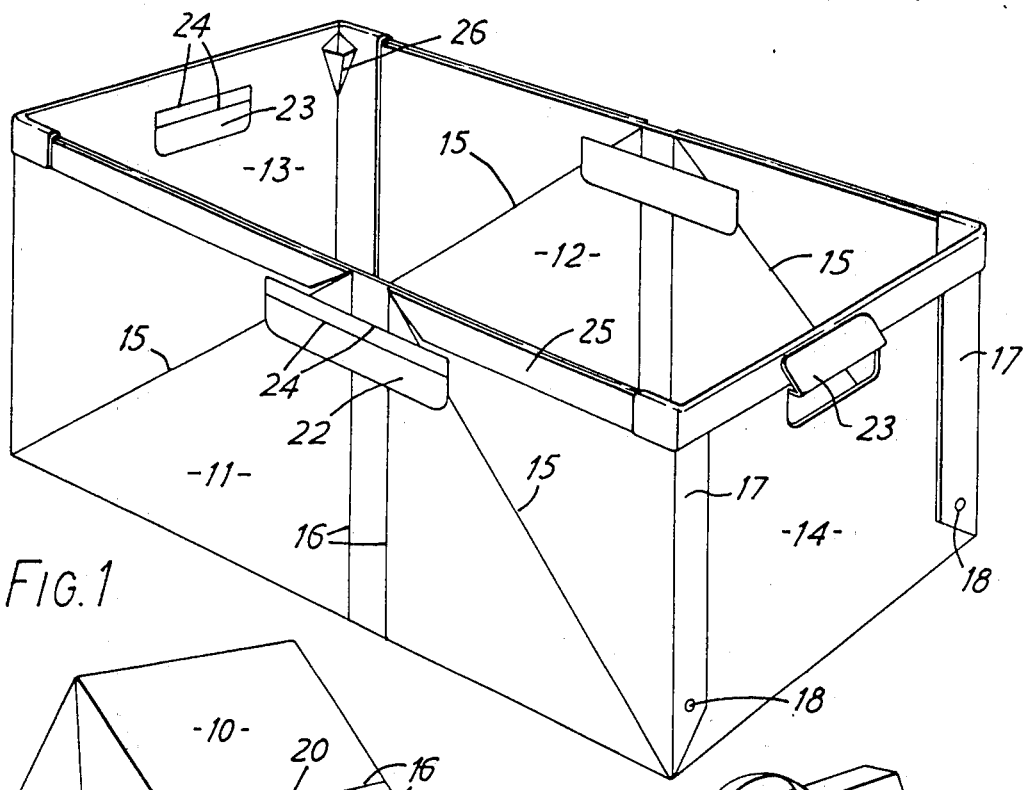
FIG. 1 is a perspective view from above of an erected container according to the invention.
Figure 2:
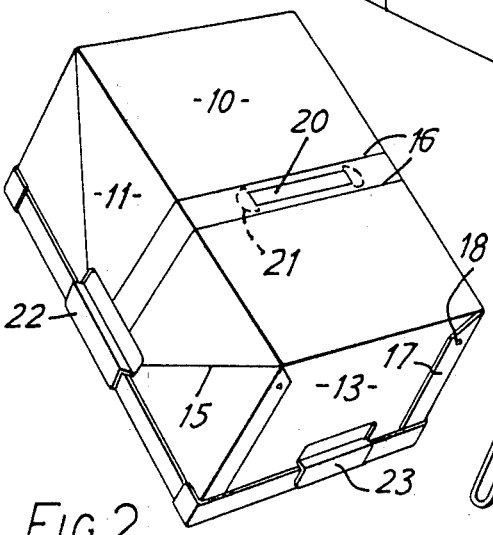
FIG. 2 is a perspective view from below of the container of FIG. 1.

As shown in FIGS. 1 and 2, a rectangular container comprises a bottom 10 and four sides or ends 11, 12, 13 and 14, the bottom and two opposite sides 11 and 12 being formed of portions or regions defined and interconnected by fold or joint lines 15 and 16.

The example shown in in the drawings may be fabricated from a single sheet of stiff plastics material, preferably polypropylene or like material having fold and hinge forming properties, and can be erected from a blank that is provided with the fold lines 15 and 16 and with the additional fold lines where the sides join the bottom. As will be readily apparent, the blank may have a cruciform plan and should include means, such as flaps 17, whereby the sides can be attached to one another, preferably permanently, to secure the container in its erected condition.

The resulting container may be collapsed, first by folding the sides 11 and 12 inwards with folding about the lines 15, whereby the remaining sides or ends 13 and 14 collapse inwards until they lie flat against the bottom. In a second stage of folding, as shown in FIGS. 3 and 4, the flat structure is folded about the fold lines 16 until a compact article is formed.

Figure 3:
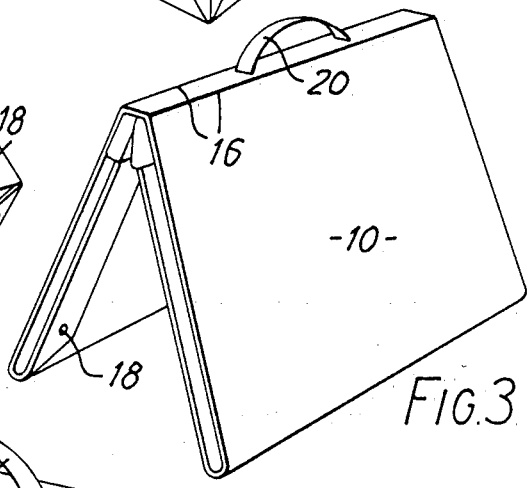
FIGS. 3 and 4 are perspective views of the same container when collapsed and respectively half folded and completely folded into its compact condition.
Figure 4:
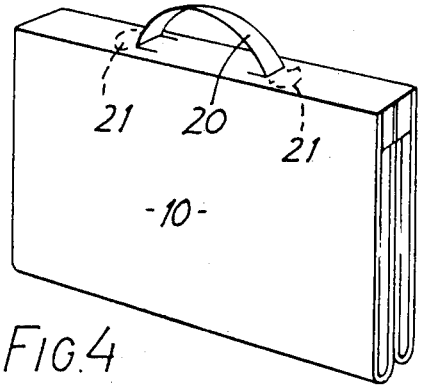

In order to retain the fully collapsed container in its compact condition, for ease of carrying, fastening means, for example press studs 18, may be fitted in appropriate positions as best understood from FIG. 3. A handle is preferably also provided, for example in the form of an additional transverse strap 20 formed with enlarged ends 21 retained within slots in the central region of the bottom 10. The fully collapsed container may then resemble a brief case of handbag in appearance, as is evident from FIG. 4.

For carrying the container when erected and loaded, handles may be provided in or on the sides 11 and 12 or ends 13 and 14, or on all sides as shown. These handles may conveniently take the form of partly cut-out flaps 22 and 23, interconnected with the main body of each side by folded lines 24. If handle flaps 22 are formed in the sides 11 and 12, in which the folds 15 are formed, the latter may extend across the flaps. When the flaps are folded round and up to form the handles, the direction of the folds 15 is radically altered, and the folded flaps serve to stiffen the erected side 11 and inhibit inward folding and collapse. Alternative means may be provided for such stiffening, for example a strip of rigid material (not shown), slidable within a top fold 25 (which may in any event be included to strengthen the top edge of the container) between a position across the folds 15 and a position clear of the folds.

A gusset element 26 may also be provided, by appropriate cutting and fold line forming in the blank, in each corner of the container. When folded out, as shown in FIG. 1, these enable erected containers to be stacked without nesting.

One significant use of containers according to the invention is in supermarkets and other stores, where they may be employed by customers for removing purchases from the store and collapsed when emptied for convenience of carrying on a subsequent visit to the store. Another use is as a temporary or carrying cot for infants in aircraft. The sides of the container may bear advertising material pertaining to the organization supplying the containers. Such material on the underside of the bottom 10 will be visible when the container is collapsed.

What is claimed is:

1. A collapsible container formed from a stiff material comprising:

a bottom having a first end, a second end, two side edges and a middle portion;

a plurality of sides each connected to one of said first end, second end and two edges and said plurality of sides being operatively affixed to adjoining sides for forming a container when in the erected condition;

said middle portion of said bottom includes a spaced pair of fold lines which extend across said bottom and along each of said sides connected to said bottom side edges for permitting said container to be folded substantially in half;

fold lines extending diagonally along each of said sides connected to said bottom side edges from a point adjacent to the intersection of said side edges and said first and second ends to a point adjacent to the intersection of said pair of fold lines and an upper surface of said sides connected to said bottom side edges to permit said sides to be folded inwardly to form a substantially flat article when collapsed; and a strap operatively connected to said bottom at a position between said pair of fold lines for providing a handle mounted exteriorly of said container when said container is in the collapsed position.

2. A container according to claim 1 including means for securing portions thereof together when the container is fully collapsed, to maintain the compact form of the article.

3. A container according to claim 1 including handles in the sides connected to each of the two side edges of the bottom in the form of partly cut out flaps extending across the fold lines of the sides, the flaps being capable of being folded over to stiffen the respective sides against folding along such lines.

4. A container according to claim 1, including handles in the sides connected to each of the two side edges of the bottom in the form of partly cut out flaps extending across the fold lines of the sides.

5. A container according to claim 1, including handles in the sides connected to each of said first and second ends of said bottom in the form of partly cut out flaps.

6. A container according to claim 1, and further including gussets normally folded and positioned adjacent to affixed adjoining sides of said plurality of sides and being manually extended to permit stacking of said container.

* * * * *